US010627184B1

(12) United States Patent
Karapetyan et al.

(10) Patent No.: US 10,627,184 B1
(45) **Date of Patent: *Apr. 21, 2020**

(54) SLINGSHOT WITH VERTICALLY ADJUSTABLE DIRECTIONAL MEMBER AND NOCK FOR ARROW PROJECTILE

(71) Applicants: Tigran Karapetyan, Los Angeles, CA (US); Sophia Karapetyan, Los Angeles, CA (US); Armen Karapetyan, Los Angeles, CA (US)

(72) Inventors: Tigran Karapetyan, Los Angeles, CA (US); Sophia Karapetyan, Los Angeles, CA (US); Armen Karapetyan, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/501,628

(22) Filed: May 14, 2019

(51) Int. Cl.
*F41B 3/02* (2006.01)

(52) U.S. Cl.
CPC ..... *F41B 3/02* (2013.01)

(58) Field of Classification Search
CPC ..... F41B 3/02
See application file for complete search history.

(56) References Cited

U.S. PATENT DOCUMENTS 2,613,659 A * 10/1952 Hutson ..... F41B 3/02 124/20.3
2,820,444 A * 1/1958 Pedersen ..... F41B 3/02 124/20.1
3,057,337 A * 10/1962 Rock ..... F41B 3/02 124/20.2
4,198,949 A * 4/1980 Cook ..... F41B 3/02 124/20.1
4,278,065 A * 7/1981 Wales ..... F41B 3/005 124/20.1
4,573,445 A * 3/1986 Webb ..... F41B 3/02 124/22
5,230,323 A * 7/1993 Saunders ..... F41B 3/02 124/17
5,501,207 A * 3/1996 Black ..... F41B 3/02 124/20.1
6,754,968 B2 * 6/2004 Lee ..... F41B 3/02 124/17
8,347,868 B2 * 1/2013 Saunders ..... F41B 3/02 124/20.1
9,581,405 B2 * 2/2017 Saunders ..... F41B 3/02
9,605,922 B1 * 3/2017 Rowe ..... F41B 3/005
9,726,451 B2 * 8/2017 Masters ..... F41B 3/02
9,746,294 B2 * 8/2017 Palomaki ..... F42B 6/06
10,030,947 B1 * 7/2018 Herring ..... F42B 6/06

* cited by examiner

*Primary Examiner* — John A Ricci

(57) ABSTRACT

The slingshot with vertically adjustable directional member and nock for arrow projectile comprises the first and second sling members, first and second elastic members, handle, subhandle, pouch with the aperture in its center, arrow nock with projection to be installed in that aperture for fixing and centering of the arrow in the pouch, and the vertically adjustable directional member for arrow support between those first and second sling members and adjustment of the arrow gravitational effect.

9 Claims, 16 Drawing Sheets

54-54

54-54

55-55

56-56

57-57

58-58

60-60
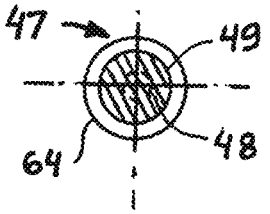
FIG. 19
61-61
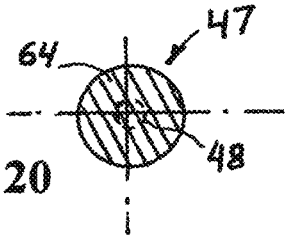
FIG. 20
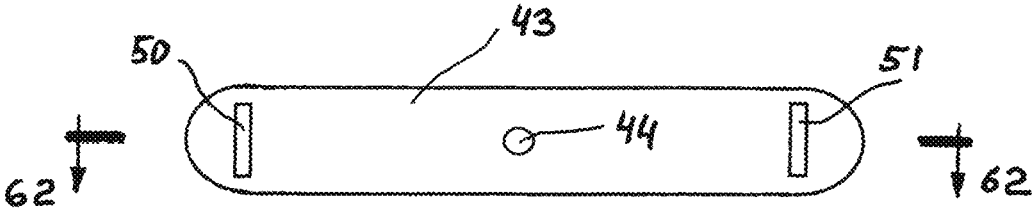
FIG. 21
62-62
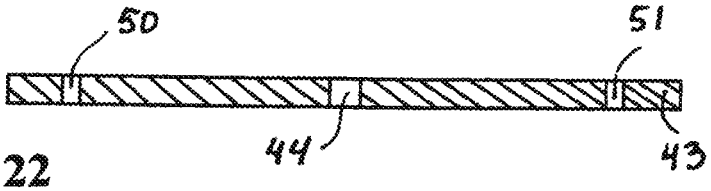
FIG. 22
FIG. 23
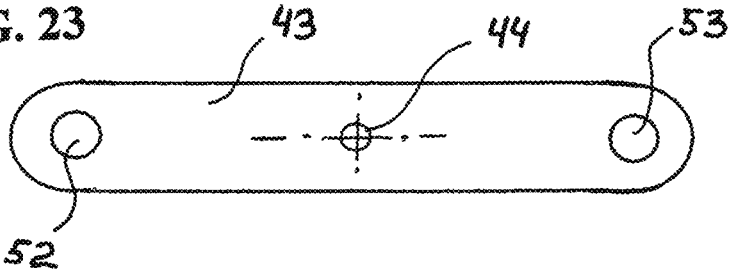

SLINGSHOT WITH VERTICALLY ADJUSTABLE DIRECTIONAL MEMBER AND NOCK FOR ARROW PROJECTILE

FIELD OF INVENTION

The present invention relates to a slingshot and more particularly, to the slingshot providing shooting of the traditional slingshot's projectile, such as balls, spheres, rounded stones and other alike slingshot's projectiles, and shooting of the arrow projectiles intended for use in the slingbow/crossbow.

BACKGROUND OF INVENTION

The articles such as slingshots, slingbow, crossbow (arbalest) are now well known.

Some devices provide shooting of the traditional objects, for instance, such as balls/spheres, rounded stones and other alike slingshot's projectiles, but there is no universality for convenient and novel use of slingshot with the traditional projectiles for slingshot as well as with the arrow projectiles to be destined for crossbow type articles, etc.

There are many known varieties of slingshots. The modern slingshots include the arm braces to be rested on the slingshot operator's arm (forearm) for more firm use of the slingshot during aiming and shooting.

For example, the slingshot construction by U.S. Pat. No. 5,230,323 describes the slingshot comprising a handle, a multi-pronged hook assembly; a pair of elastic bands, a pouch, an arm brace, and a retaining clip.

The handle comprises a pistol grip handle member having a generally flat top. The handle member is further provided with an elongated recess which is dimensioned to receive a portion of the clip, and a peripheral recess which is dimensioned to receive portions of the hook assembly and the arm brace. The multi-pronged hook assembly comprises a symmetrically configured metal rod member having a U-shaped horizontally disposed yoke portion which is dimensioned to be received in the peripheral recess of the handle member. In addition the metal rod member is further provided with a pair of outwardly and upwardly projecting arm elements which terminate in rearwardly facing, angled prong members. Each of the prong members comprise a pair of angularly offset hook elements which are secured to the ends of the respective arms via a cylindrical mounting bracket provided with a locking nut, and comprise that U-shaped metal rod, which is rigidly fastened to, and surrounds the opposite sides of the cylindrical mounting element. The cylindrical mounting element is secured to each of the prong members in such manner that one hook element is disposed at an upwardly and outwardly angled orientation relative to one prong member, and the other hook element is disposed at a downwardly and inwardly angular orientation relative to the other prong member. The elastic bands each of which comprises an elongated length of thin walled rubber tubing, wherein the open ends are adapted for interchangeable frictional attachment to the hook elements on either one of the hook members. Each of the elastic bands employed in invention has an actual length that is at least twice the distance of its effective length, since the rubber tubing is formed into a loop to establish the operative engagement between each elastic band and one of the prong members. The pouch comprises a flexible pouch member having a pair of aligned generally horizontal slits formed proximate each of the ends of the pouch member, wherein the slits on each end of the pouch member are dimensioned to slidably receive the intermediate portion of the elastic bands. The arm brace comprises a generally U-shaped collar having an intermediate yoke portion for the peripheral recess in the handle member, wherein the outboard ends of the collar is provided with an arm strap which extends over the user's (operator's) forearm when the handle is gripped. The clip comprises a clip member having spring loaded capture arms disposed on its opposite ends; wherein, the clip member is dimensioned to be received in the recess in the top of the handle to captively retain the multi-pronged hook assembly and the arm brace relative to the handle member.

Such slingshot does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect/principles of the arrow-type projectiles during their flying process to the target.

Another U.S. Pat. No. 5,501,207 describes some kind similar arm braced slingshot, including a U-shaped frame and sling, the frame having elongated rod-like substantially parallel spaced-apart legs interconnected at their forward ends by a bight portion, which is similar to rod-like and provides with right and left handle threads cooperatively received by nuts rigidly secured to the respective frame leg. Rearwardly of the bight portion a cylindrical handle extends between and surrounds an intermediate portion of the respective leg at its respective end portions to be grasped by a user's hand in palm down position. The saddle straps extend transversely between the frame legs in front to rearward spaced relation. Each of the saddle straps is provided with loops at their respective ends for surrounding intermediate portions of the respective frame legs and overlie the upper portion of a user's forwardly extended forearm to support the frame legs on respective sides of the forearm when in use. The frame legs are bent laterally medially their ends in parallel relation at an acute angle to conform to the user's forearm forwardly of the elbow. The elongated strap are secured to its opposite surfaces, in selected positions, is wrapped around the frame legs and user's forearm, over the rearward strap to prevent vertical movement of the rearward end portions of the frame legs relative to a user's forearm when grasping the handle and projecting a projectile. The forward end portions of the frame legs are turned upwardly at the position of the bight portion to form a pair of inverted L-shaped posts normal to the longitudinal axes of the legs. The posts each have an elongated standard portion. The pair of posts each have a foot portion, respectively on the respective standard. The foot portions project rearwardly in parallel relation at an angle with respect to the longitudinal axis of the respective frame leg. One foot portion is formed longer than the other foot portion, so that the terminal ends of the foot portions terminate in a plane extending transversely of the foot portions and normal to the longitudinal axes of the foot portions for connection with equal lengths sling strands as will now be described. Also, the sling comprises a pair of equal length elongated flexible elastic tubular members respectively connected at one end portion with the respective terminal end portion of the respective post foot portion. The other ends of the flexible strands or members are respectfully connected with one end of a projectile pocket which nests a projectile.

Additionally, the sling includes a counterweight, supported by one end of a forward and downwardly projecting rod-like member. The counterweight is secured to the medial portion of the bight portion by a threaded coupling element. One end portion of the hand grip is secured to one end portion of a strap-like hand grip portion. The other end portion of the palm grip strap is secured to an upstanding rod-like prong in wrap-around relation. The prong is secured at its depending end portion to the frame leg rearwardly of the hand grip by a clamp. The lock nuts, surrounding the respective post standard, secure the respective standard and position its respective foot portion in parallel selected angular relation with respect to the longitudinal axes of the frame legs.

Such slingshot does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect of the arrow-type projectiles during their flying process to the target.

The U.S. Pat. No. 6,754,968 discloses slingshot comprising a folding wrist brace, a forked body with a first arm and a second arm extending from a hand grip portion, a pouch for launching a projectile toward a target, and first and second elastic members respectively for providing the force to launch the projectile. First elastic member has a first end connected to first arm and a second end connected to pouch. Second elastic member has a first end connected to second arm and a second end connected to pouch. Also, the slingshot includes a light projecting device for projection of a light (laser) beam. Aligning and light activating apparatus is provided to align light beam with target and to activate light source of light projecting device in response to slingshot being moved into the projectile launching position.

This slingshot in the same manner does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect of the arrow-type projectiles during their flying process to the target.

The slingshot, known by the U.S. Pat. No. 8,347,868, includes a front panel, a rear panel, a handle, an axle, a pair of arms, and a pair of locking clips. The front panel, the rear panel, the handle, the arms, and the locking clips are constructed of a rigid, lightweight plastic material. The front panel and the rear panel are gauntlet-shaped in order to surround and shield the top surface of a shooter's arm when in the opened on unfolded configuration. The front panel and the rear panel are connected via a hinged connection, which is created by nubs defined in the rear panel mating with holes in the front panel. The front panel is comprised of an integrated port to accept an upper portion of the handle when the slingshot is in a fully-collapsed (fully-folded) configuration. The rear panel is comprised of an integrated port to accept a part of a lower portion of the handle when the slingshot is in a fully-collapsed configuration. The ends of the axle slide into bores defined on the arms. The center portion of the axle slides through an aperture on the front panel and a bore on the handle, thereby connecting the arms and handle to the front panel. The grooves are positioned at the other end of the arms and coupled with the locking clips, which are of semi-circular shape and are comprised of three main integrated elements: a large-diameter end designed to secure flat elastic bands, a small diameter end designed to secure tubular bands (which, generally, are thicker than flat bands), and a grip designed to facilitate engagement and removal of the locking clips within the grooves. This slingshot also includes an open-pocket pouch.

This collapsible locking slingshot employs a pair of arms that when in the firing position are substantially parallel to the slingshot user's arm, which provides not perfect aiming. Additionally, such slingshot does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect of the arrow-type projectiles during their flying process to the target.

The U.S. Pat. No. 9,581,405, describes the slingshot with handle guard and palm plate. The slingshot comprises a handle, a pair of arms extending upwardly and forwardly from handle with band attachment devices attached to the ends of arms. Also, the slingshot includes an arm brace, and a retaining clip for securing arm brace and arms to the handle. Additionally, a bail guard is attached to arm brace. The handle is formed as a pistol grip handle member has a flat top, which is provided with an elongated recess which is dimensioned at one end to receive a portion of retaining clip and dimensioned at the other end to receive a portion of a handle guard. The retaining clip secures one end of handle guard to the top of handle. The handle further includes a gripping portion extending from the mounting base, which includes a peripheral groove, extending at least partially about the periphery of the mounting base, in which the arms and the arm brace are secured by the retaining clip. The forward face of handle, at the gripping portion, is formed with grips to aid a user's gripping of handle. A groove is formed at the bottom of the forward face of handle, and is dimensioned to slidably receive a tongue formed at one end of handle guard in order to secure handle guard to the bottom the forward face of handle. In the bottom portion of the rearward face of the gripping portion of handle, a plurality of positioning elements are formed extending from the bottom of the rearward face of handle and spaced apart upwardly for a distance along the rearward face of handle. Each groove is associated with a pair of recesses, with respective recesses of the pair positioned at opposite sides of the groove. Each recess comprises a post configured to matingly engage a collar formed on opposing arms of a palm plate, which is positioned along the length of handle. Palm plate is a small, plate-like member comprising a body, a pair of arms extending rearwardly and upwardly from body, and a lip extending rearwardly from body and disposed between arms. Arms are formed with collars at the distal ends thereof. Collars are dimensioned to straddle at least a portion of the handle and matingly engage posts of recesses of handle, while lip is dimensioned to matingly engage grooves of handle. The handle guard extends forwardly from handle in an arcuate manner, from the bottom of the forward face of handle to the top of handle. A tongue is formed at one end of handle guard. At the other end of handle guard are formed an aperture and an elongated recess adjacent to the aperture. Aperture is dimensioned to receive retaining clip therethrough while elongated recess is dimensioned to receive a portion of retaining clip.

This device inherits most of the same known deficiencies, i.e.: does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect of the arrow-type projectiles during their flying process to the target.

Some of the known devices for shooting of the traditional slingshot's projectiles (e.g., balls, spheres, rounded stones, etc.) present not a traditional U-shape or Y-shape of the slingshots, but the slingshots in the form of gun-type slingshots. For example, the U.S. Pat. No. 4,278,065 discloses the slingshot type gun in the general configuration of a rifle. The slingshot type gun comprises a stock (base), the forearm of which constitutes a hand grip. The gun stock is adapted along opposite sides for the purpose of receiving a release mechanism. The release mechanism is located so as to correspond to that area normally occupied by a gun trigger mechanism. A stationary member of the release mechanism is secured to the gunstock by fastener pins. A movable member of the release mechanism is retained in place by means of a pivot pin. Both members extend below the gunstock to provide handgrips. Stationary and movable release members also extend above the stock and include opposed surfaces between which a segment of stretched elastic component is retained. Release mechanism also includes a bail (latch) to prevent inadvertent opening movement of the movable member. Such a bail arrangement constitutes a "safety" for the gun. Indicated at 16 is an aperture through which the shooter may view the target, the aperture may be in the nature of a peep sight. To assure proper vertical positioning of portion of the elastic component carrying the projectile within the release mechanism, the pair of notches is provided. At the forward end of base are located a pair of supports which curve upwardly and rearwardly to receive the encompassing forward end of elastic component. Each support is secured by fasteners fitted within a block member affixed to the forward end of the base by fasteners.

Such gun-style slingshot is complex and expensive, requires the presence of the release mechanism, does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect (principles) of the arrow-type projectiles during their flying process to the target.

Another gun-type slingshot is presented by U.S. Pat. No. 9,605,922. This slingshot firearm includes a foothold mechanism that essentially allows energy-storing rubber bands to be extended with the power of one or two hands. The rubber bands are retained in a ready-to-fire position by a set of retaining fingers in an action while a user takes a careful aim at an intended target with the assistance of an included laser pointer. Also, slingshot comprises the projectile storage cavity provided in a stock of the apparatus (slingshot), a slide member, to which a firing yoke is mounted, an action incorporated within the stock, a sling that includes rubber bands and a pouch. The stock is configured to be a traditional single-piece gunstock, having a butt with a thumbhole, a fore-end. The butt tapers toward the approximate middle of the stock from the toe to the location of a grip. The grip is configured to have a steeper angle cut into the butt for more precise control by a firing hand. The projectile storage cavity is cut into the butt in proximity to a lower end of the grip. The projectile storage cavity is a cylindrical chamber oriented along a medial line perpendicular to a midline of the grip.

A cap is inserted into the open end of the projectile storage cavity to retain the reserved projectiles. The fore-end is configured to have a square, or rectangular, cross-section with a slide cavity located along a medial horizontal plane. The top plate is adapted to have an appropriate cross-section along the length so as to adequately fill any gaps that may exist between the slide member, the slide cavity, the action, and an action cavity. The top plate is secured to the stock with a plurality of threaded plate fasteners inserted through apertures in the top plate. A laser cavity, for the insertion of a laser pointer, is disposed at a distal end of the slide member. The laser cavity is aligned along a central axis of the slide member and penetrates the slide member to a sufficient depth to enclose the laser pointer. A plurality of adjustment screws is disposed along the perimeter of the slide member and configured to project into the laser cavity so as to contact the laser pointer. The slide latch mechanism is disposed at an open end of the slide cavity. The slide latch mechanism includes a latch bar and a latch spring retained in a latch cavity of the fore-end. The latch bar is pivotally attached to a latch plate by a latch pin inserted through aligned apertures in the latch bar. The latch plate is adapted to have a button aperture through which the latch release button extends. The loop-shaped foothold is attached to the distal end of the slide member. The sling is positioned atop the distal end of the slide member along a crest, and sling includes a firing yoke and the attached rubber bands with the pouch. The firing yoke is configured to be two vertical yoke arms having double ends attached to a horizontal member. The firing yoke is configured with the double end on each yoke arm to support the utilization of two rubber bands at each side of a pouch. The action is adapted to be a projectile release mechanism housed within an action cavity in the stock. The action cavity is configured to have any appropriate number of internal planar, or convoluted, surfaces, to provide a clearance for moving parts of the action. A specific trigger gap is provided in the action cavity for the movement of the trigger in use. The mounting plate is attached to a lower horizontal face of the action cavity by means of a plurality of appropriate threaded mounting plate fasteners. Disposed on a lower face of the mounting plate is a trigger clevis, configured to be a pair of trunnion plates with aligned apertures for the installation of a trigger pivot pin about which the trigger can execute a partial rotation. A trigger notch is formed into a leading edge of the mounting plate to provide clearance through which a firing pin actuator of the trigger can project.

The front plate and a rear plate are attached to an upper face of the mounting plate. The front plate and the rear plate are oriented perpendicularly to the mounting plate. The front plate is provided with a front plate aperture, while the rear plate has a rear plate aperture aligned along a longitudinal axis with the front plate aperture. A cylindrical firing pin is installed between the front plate and the rear plate, having a first end projecting through the rear plate aperture and a second end projecting through the front plate aperture. A flange, configured to be an annular ring, is disposed near the first end of the firing pin. The flange is located between the front plate and the rear plate. A trigger groove is disposed in a lower side of the firing pin in proximity to the second end of the firing pin. A compression-type return spring is assembled around the firing pin and trapped between a rear face of the front plate and a front face of the flange.

Also, the first finger and the second finger are symmetrical about a central axis. The fingers are the cylindrical rods with a horizontal base rod attached to a finger pivot post affixed to the mounting plate, and the longitudinal axis of the base rod is aligned parallel to the longitudinal axis of the mounting plate. The first and second fingers are secured by means of threaded finger pivot fasteners inserted into apertures in the base rod, thereby forming finger pivots. The fingers are "L"-shaped at a rear side of the base rod. The fingers project through a finger aperture. A safety pin of a cylindrical form is positioned in proximity to the second end of the firing pin, and inserted through a safety pin aperture in the stock. A gap, disposed in the safety pin shaped to comply with the profile of the cylindrical firing pin. The gap is in alignment with the firing pin and the firing pin, and is moving forward by the action of rotating the trigger about the trigger pivot, thereby providing a shooting. A safety pin spline is formed on the safety pin so as to prevent the gap from improperly rotating out of a possible alignment with the firing pin. Additionally, a trigger guard is attached to the stock by means of threaded trigger guard fastener. The rubber bands are extended by adjusting the position of the slide member relative to the fore-end so as to store energy in the rubber bands. When the projectile is intended to be released, the safety pin is adjusted so to disengage from the second end of the firing pin and to allow the firing pin to be operated.

Such gun-style slingshot requires the presence of the release mechanism, does not provide a pivotability of the wrist with the slingshot's handle in it for the better aiming, keeping at the same time the same position of the arm support (arm brace) on the forearm, and does not comprise the improved arrow's nock and improved pouch with the aperture in the center of the pouch for fixing and centering projectiles in the pouch, avoiding bias of projectiles from the center of the pouch, and providing more firm finger gripping of the traditional slingshot's projectiles or the arrow-type projectiles during shooting, and does not provide the vertical adjustment of the arrow directional member due to the gravitational effect of the arrow-type projectiles during their flying process to the target. Additionally, such slingshots are complex and expensive.

Also, some of the known devices for shooting of projectiles, describe only crossbow (arbalest) structures without possibility of universality for shooting not only the arrow-style projectiles intended for arbalests/crossbows, but also shooting of the traditional slingshot's projectiles (e.g., balls, spheres, rounded stones, etc.) For example, the U.S. Pat. No. 9,746,294 discloses the crossbow with the lobed nock for crossbow bolts (arrows). The crossbow comprises a stock, a trigger assembly, a handgrip, a flight groove, and rails on each side of the flight groove, a front end and a rear end, a foot stirrup and a plurality of limbs attached at the front end, a bowstring extending across the limbs and moving along the stock adjacent to the rails. The crossbow also comprises sights and a quiver to hold extra bolts. The crossbow's projectile is a crossbow bolt. The bolt comprises an elongated shaft, an arrow point, a plurality of vanes, and a nock.

This arbalest does not provide an opportunity to be used as a slingshot for shooting the traditional slingshot's projectiles, for example, such as balls, spheres, rounded stones and other alike slingshot's projectiles. Additionally, such slingshots are complex and expensive.

Another slingshot for arrow only, by U.S. Pat. No. 4,573,445, comprises a handgrip, a long barrel and a device for propelling the arrow through the barrel. The handgrip has a wide top portion and a narrow handle portion. The long barrel is open at both ends and is secured at the rear to the top portion of the handgrip in a notch (e.g. by adhesive). The device is also secured to the top portion of the handgrip at slits. A brace member (barrel's support) is secured at an oblique angle between front portion of the barrel and forward middle portion of the top portion of the handgrip. The barrel contains a front sight and an open rear sight so that the arrow can be accurately aimed. The device consists of an arrow receiving nocking member and a pair of parallel elastic bands connecting the nocking member to the top portion of the handgrip. The nocking member consists of a pair of straps and a wire. Each strap is affixed at one end to one elastic band while the wire is affixed transversely between the pair of straps to engage nock of the arrow. The grip handle extender has a central aperture to engage the narrow handle portion of the handgrip for better hold on the handgrip. Also, the arrow slingshot can comprise another device (further defined as a portion) which includes the top portion having a pair of parallel spaced slots, a pair of plates and a pair of set screws. The slots are co-extensive in length with the top portion. Each slot is wide enough to accommodate width of free end of one elastic band. Each elastic band contains an enlarged portion at the free end forming a T-shape.

This arrow slingshot does not provide an opportunity to be used as a slingshot for shooting the traditional slingshot's projectiles, for example, such as balls, spheres, rounded stones and other alike slingshot's projectiles.

The traditional style of slingshots is less complicated than arbalests. One of the traditional slingshots, disclosed in the U.S. Pat. No. 10,030,947, can be used for shooting of the slingshot's traditional projectiles and arrow-type projectiles. On one end of the shank, the nock includes a flared or bulging element. The purpose of the flared element is to provide a stop, grip, nodule, bulb etc. that facilitates gripping of the nock when an arrow or bolt is being loaded for shooting. The flared element includes three flanges that extend outward from the surface of the shank.

The flanges taper outward and backwards at an angle of 45° from the surface of the shank for a first distance, and then curves or turns to extend backwards and parallel from the shank. The overall diameter of the flared element is larger than the diameter of the shank and the flared element is of sufficient diameter to allow adequate grip when held in the pocket of the slingbow or slingshot. Also, the diameter of the shank can be reduced proximate to the flared element to create disparity in the diameter of the flared element and the shank at the location where the nock is being held. On the other end of the shank, distal from the flared element, the nock includes a connection shaft. The connection shaft extends from the shank and is coaxially aligned with it. The purpose of the connection shaft is to mate with and attach to the shaft of an arrow or bolt. The connection shaft should be configured to securely connect or attach to the arrow shaft. The connection shaft should be of a diameter that is less than the diameter of the shank in order to slide within the interior of an arrow shaft. A ridge, extending along a portion of the surface of the connection shaft, is slightly raised above the surface of the connection shaft and creates pressure against the inner side wall of the arrow shaft when inserted. The connection shaft can include a plurality of such ridges to create a strong frictional hold of the nock to the arrow, or a plurality of nodules or protrusions can also be utilized. Protrusions from the surface of the connection shaft can mate or correspond with detents within the interior of the arrow shaft or holes or apertures in the arrow shaft. After the connection shaft is inserted, the arrow shaft can be crimped to hold the nock in position. Still further, in some embodiments the connection shaft may include a threaded ridge that can be screwed into the interior shaft of the arrow. In yet other embodiments, the arrow shaft interior may also include threads for receiving a threaded connection shaft. In yet other embodiments, an insert may be glued or otherwise connected within the interior of the arrow shaft for receiving a threaded connection shaft. The gaps in the flanges can additionally re-duce resistance when passing through the whisker biscuit or the air during shooting the arrow or bolt with a traditional bow or crossbow.

The slingbow includes a hand grip and an arm support (arm brace). The user grasps the hand grip and the arm support rests on the users forearm. The slingbow also includes two arms that are attached to the hand grip, forming the U-type slingshot. On the ends of the two arms, elastic bands are attached and the elastic bands are attached to the pocket (pouch). The can be constructed of leather, plastic, rubber, cloth, etc. A whisker biscuit (arrow support) is connected to the hand grip between the two arms. An arrow with the nock can be inserted into the slingbow by placing the flared element into the pocket and the shaft of the arrow into the whisker biscuit. The flared element is then pinched by a user as the arrow is drawn back and the bands stretched. Upon release of the pocket, the arrow is launched.

This device by U.S. Pat. No. 10,030,947 is presented by FIG. 1 (Prior Art) in the chapter BRIEF DESCRIPTION OF THE DRAWING hereinbelow.

Such device, having a structure different from the improved slingshot with vertically adjustable directional member and nock for arrow projectile does provide a pivotability of the wrist with the slingshot's handle in it for the better aiming, keeping at the same time the same position of the arm support (arm brace) on the forearm, but does not comprise an improved arrow's nock and does not comprise an improved pouch with the aperture in the center of the pouch for fixing and centering projectiles in the pouch, avoiding bias of projectiles from the center of the pouch thereby providing firm (non-sliding) finger gripping of the traditional slingshot projectiles or the arrow-type projectiles during shooting, and does not provide the vertical adjustment of the arrow directional member due to the gravitational effect of the arrow-type projectiles during their flying process to the target.

All known prior art inherits the deficiencies described hereinabove.

The purpose of the present invention is therefore to provide: an effective, not expensive not complex, slingshot for shooting of the traditional slingshot's projectiles (balls, spheres, rounded stones and other alike slingshot's projectiles); as well as shooting of the arrow-type projectiles intended for use in the slingbow/crossbow; and to provide for such universal device a pivotability of the wrist with the slingshot's handle in it for the better aiming, keeping at the same time the same position of the arm support (arm brace) on the forearm; and a pouch with the aperture in the center of the pouch for the improved arrow's nock fixing and centering of the arrow (or the traditional slingshot's projectiles) in the pouch and more firm and correct finger grip of the traditional slingshot's projectiles or the arrow-type projectiles without their bias in the pouch; and to provide for such universal device a vertical adjustment of the arrow directional member for possible consideration and correction of the gravity of the arrow-type projectiles during their flying process to the target.

Thus, there is a great need in the art for the improved not complex, not expensive, efficient and reliable universal slingshot with vertically adjustable directional member and nock for arrow projectile.

SUMMARY

All known prior art inherits the deficiencies described hereinabove.

The purpose of the present invention is therefore to provide: an effective, not expensive not complex, slingshot for shooting of the traditional slingshot's projectiles (balls, spheres, rounded stones and other alike slingshot's projectiles); as well as shooting of the arrow-type projectiles intended for use in the slingbow/crossbow; and to provide for such universal device a pivotability of the wrist with the slingshot's handle in it for the better aiming, keeping at the same time the same position of the arm support (arm brace) on the forearm; and a pouch with the aperture in the center of the pouch for the improved arrow's nock fixing and centering of the arrow (or the traditional slingshot's projectiles) in the pouch and more firm and correct finger grip of the traditional slingshot's projectiles or the arrow-type projectiles without their bias in the pouch; and the vertically adjustable directional member for arrow support and adjustment of the arrow gravitational effect.

Therefore, there is a great need in the art for the improved not complex, not expensive, efficient and reliable universal slingshot with vertically adjustable directional member and nock for arrow projectile.

The improved slingshot with vertically adjustable directional member and nock for arrow projectile comprises the first and second sling members, first and second elastic members, handle, subhandle, pouch with the aperture in its center, arrow nock with projection to be installed in that aperture for fixing and centering of the arrow in the pouch, and the vertically adjustable directional member for arrow support between those first and second sling members and adjustment of the arrow gravitational effect.

With respect to the description of this invention, it is to be realized that the optimum dimensional relationships for the parts of the invention, to include variations in size, materials, configurations, shape, form, function and manner of operation, assembly and use, are deemed readily apparent and obvious to one skilled in the art, and all equivalent relationships to those illustrated in the drawings and described in the specification are intended to be encompassed by the present invention.

Any and all additional modifications and improvements of the present invention may also be apparent to those of ordinary skill in the art. Thus, the particular combination of parts/components/members/portions described and illustrated herein is intended to represent only certain embodiments of the present invention, and is not intended to serve as limitations of alternative devices within the spirit and scope of the invention.

BRIEF DESCRIPTION OF THE DRAWING

Additional features of the present disclosure will become apparent to those skilled in the art upon consideration of illustrative embodiments exemplifying the best mode of carrying out the disclosure as presently perceived.

In order that the invention and the manner in which it is to be performed can be more clearly understood, embodiments thereof will be described by way of example with reference to the attached drawings, the detailed description of which particularly refers to the accompanying figures. Referring to FIGS. 2-19, disclosing a slingshot with vertically adjustable directional member and nock for arrow projectile (herein below described as the "improved slingshot"), the referral numerals are presented in the regular manner starting from numeral "1" (one).

FIG. 1 (Prior Art) is a general view of the device by U.S. Pat. No. 10,030,947, marked in that patent as FIG. 11.

FIG. 2 is a simplified front view of the improved slingshot with the vertically adjustable directional member at the nominal position for arrow projectiles.

FIG. 3 is a simplified front view of the improved slingshot with the vertically adjustable directional member at the adjusted position for arrow projectiles.

FIG. 4 is a simplified front cross-sectional view 54-54 of the improved slingshot.

FIG. 5 is a simplified top view of the improved slingshot.

FIG. 6 is a simplified side cross-sectional view 55-55 of the improved slingshot.

FIG. 7 is a simplified cross-sectional view 56-56 of the handle of the improved slingshot with the handle insert and without vertically adjustable directional member for arrow projectiles.

FIG. 8 is a simplified cross-sectional view 57-57 of the handle of the improved slingshot with the handle insert and another variant of subhandle.

FIG. 9 is a simplified drawing of the handle of the improved slingshot.

FIG. 10 is a simplified front cross-sectional view 58-58 of the handle of the improved slingshot.

FIG. 11 is a simplified drawing of the improved slingshot with the inserted first and second sling members.

FIG. 12 is a simplified cross-sectional view of the improved handle insert.

FIG. 13 is a simplified front cross-sectional view of the improved subhandle.

FIG. 14 is a simplified drawing of the front view of the improved vertically adjustable directional member for arrow projectiles.

FIG. 15 is a simplified cross-sectional view 59-59 of the improved vertically adjustable directional member for arrow projectiles.

FIG. 16 is a simplified front view of another variant of the vertically adjustable directional member for arrow projectiles.

FIG. 17 is a simplified drawing of the rear portion of the arrow (arrow projectile) with the improved nock.

FIG. 18 is a simplified drawing of the improved nock.

FIG. 19 is a simplified cross-sectional view 60-60 of the improved nock.

FIG. 20 is a simplified cross-sectional view 61-61 of the improved nock.

FIG. 21 is a simplified front view of the first variant of the improved pouch.

FIG. 22 is a simplified cross-sectional view 62-62 of the first variant of the improved pouch.

FIG. 23 is a simplified front view of the second variant of the improved pouch.

THE DRAWING REFERENCE NUMERALS

Figure 1:
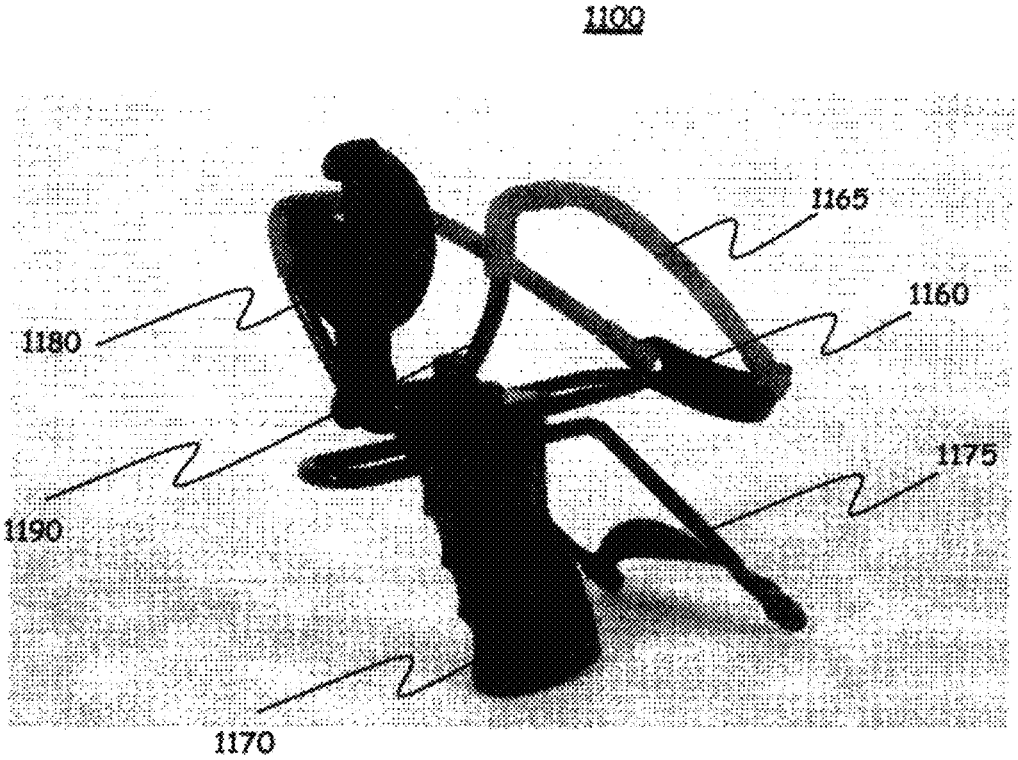
FIG. 1 (Prior Art)
Referring to FIG. 1 (Prior Art), the known device is presented with its own referral numerals.

1—an improved slingshot;
2—a handle; 1
3—a subhandle;
4—a first sling member;
5—a second sling member;
6—a vertically adjustable directional member for arrow projectile;
7—a body of the vertically adjustable directional member 6;
8—a ring of the vertically adjustable directional member 6;
9—an upper portion of the first sling member 4;
10—an upper portion of the second sling member 5;
11—an outer thread of the body 7 of the vertically adjustable directional member 6;
12—a handle insert;
13—an inner thread of the handle insert 12;
14—a truncated conic portion of the handle insert 12;
15—an outer surface of the handle insert 12
16—a handle opening;
17—an inner surface of the handle opening 16;
18—an inner thread of the handle 2;
19—an outer thread of the subhandle 3;
20—a first opening of subhandle 3;
21—a second opening of subhandle 3;
22—a first arm of the arm rest;
23—a second arm of the arm rest;
24—a lower portion of the first sling member 4;
25—a lower portion of the second sling member 5;
26—a first projection of the subhandle 3;
27—a second projection of the subhandle 3;
28—a first sprang member of the vertically adjustable directional member 6;
29—a second sprang member of the vertically adjustable directional member 6;
30—an horizontal axis;
31—an adjusted axis;
32—a vertical axis;
33—a direction of shooting;
34—an axis of shooting;
35—a first elastic member;
36—a second elastic member;
37—a first end of the first elastic member 35;
38—a first end of the second elastic member 36;
39—a second end of the first elastic member 35;
40—a second end of the second elastic member 36;
41—a first groove for the first elastic member 35;

42—a second groove for the second elastic member 36;
43—a pouch;
44—an aperture;
45—an arrow projectile;
46—a rear portion of the arrow projectile 45;
47—a nock;
48—a nock projection;
49—a nock member;
50—a first slot;
51—a second slot;
52—a first hole;
53—a second hole;
54-54—a cross-sectional view;
55-55—a cross-sectional view;
56-56—a cross-sectional view;
57-57—a cross-sectional view;
58-58—a cross-sectional view;
59-59—a cross-sectional view;
60-60—a cross-sectional view;
61-61—a cross-sectional view;
62-62—a cross-sectional view;
63—an outer surface of the nock member 49;
64—a nock middle member;
65—an upper surface of the truncated conic portion 14;
66—a nut;
67—a texture;
68—a lower inner portion of the ring 8;
69—an upper portion of the handle 2;
70—a lower portion of the handle 2;
71—an upper portion of the body 7;
72—a direction of unscrewing of the vertically adjustable directional member 6;
73—a gasket.

DETAILED DESCRIPTION

In accordance with the disclosed invention, the best mode is presented in terms of a one or more of the disclosed embodiments, herein depicted within FIGS. 2 through 19. However, the disclosure is not limited to a single described embodiment and a person skilled in the art will appreciate that many other embodiments are possible without deviating from the basic concept disclosed by the present disclosure and that any such work around will also fall under its scope. There are shown in the drawings and will be described herein, in detail, the preferred embodiments of the present invention. It should be also understood, that the present disclosure is to be considered as an exemplification of the principles of the invention and is not intended to limit the spirit or scope of the invention and/or claims of the embodiments illustrated. There are no limitation with respect to the specific methods and apparatus illustrated herein is intended or should be inferred. It is, of course, intended to cover all such modifications as fall within the scope of the appended claims following hereinbelow.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated. The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical", etc. are used to describe a relationship of one (1) element, feature and/or region to another element, feature and/or region as illustrated in the figures.

Referring to FIG. 1 (Prior Art), the view of the known slingbow is presented with its own referral numerals.

Figure 2:
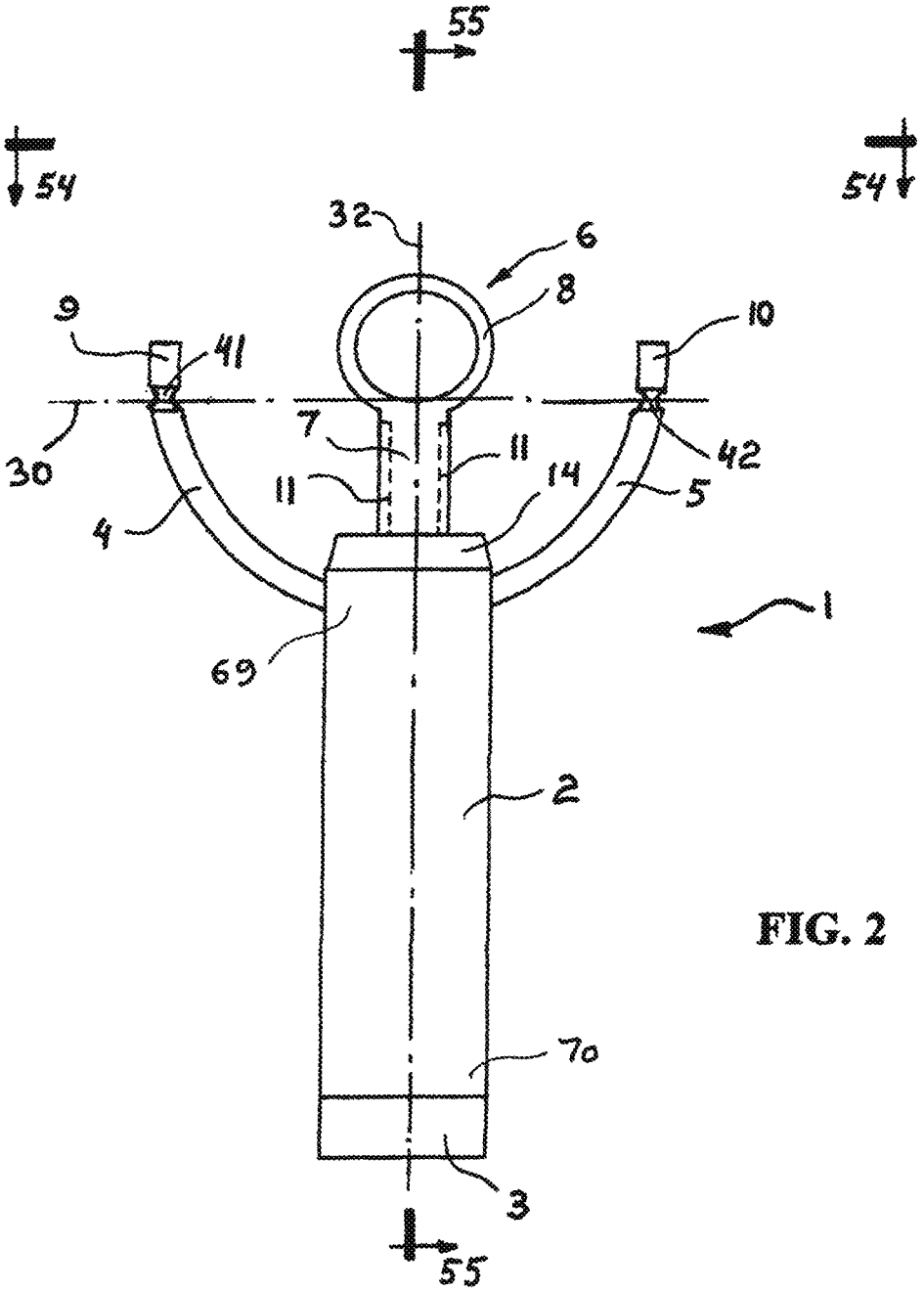
Figure 3:
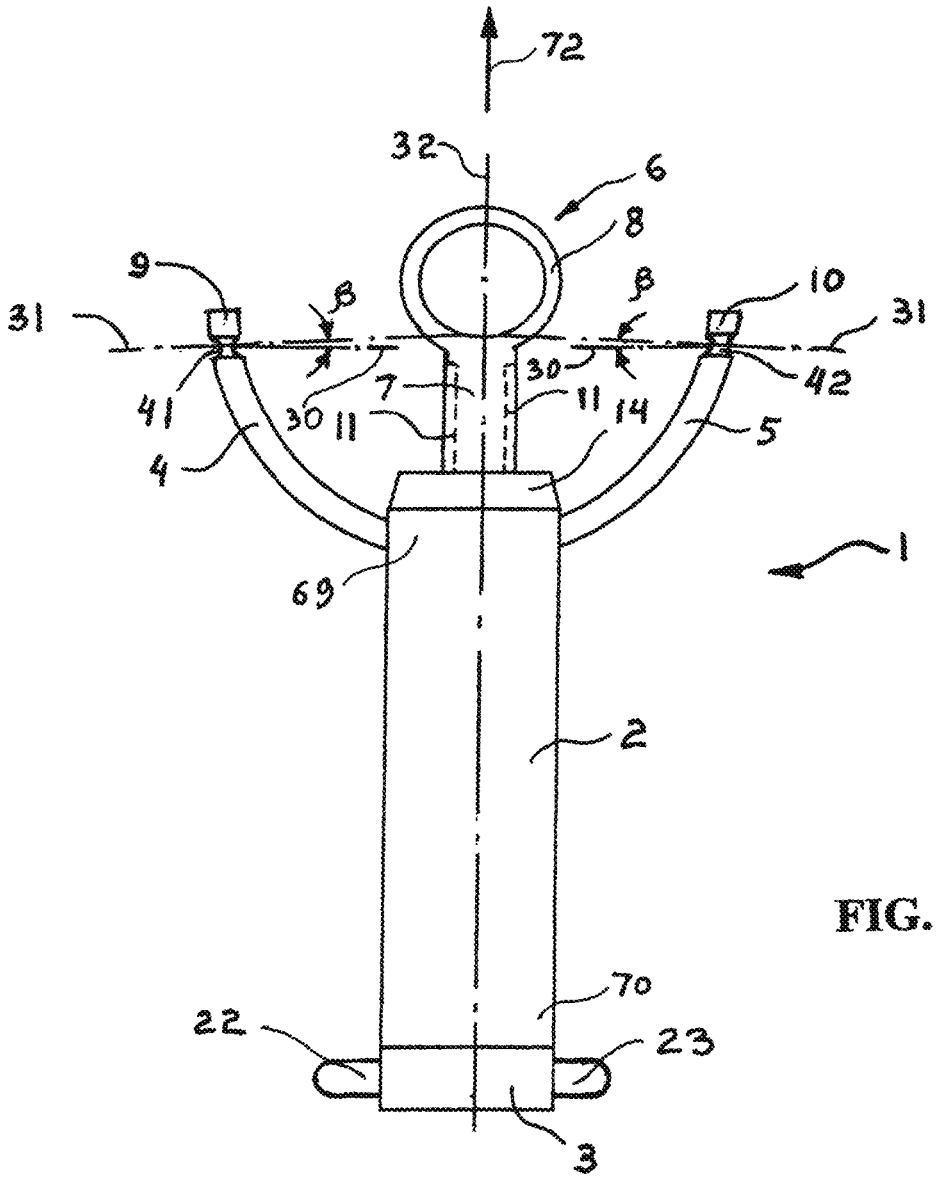
Figure 4:
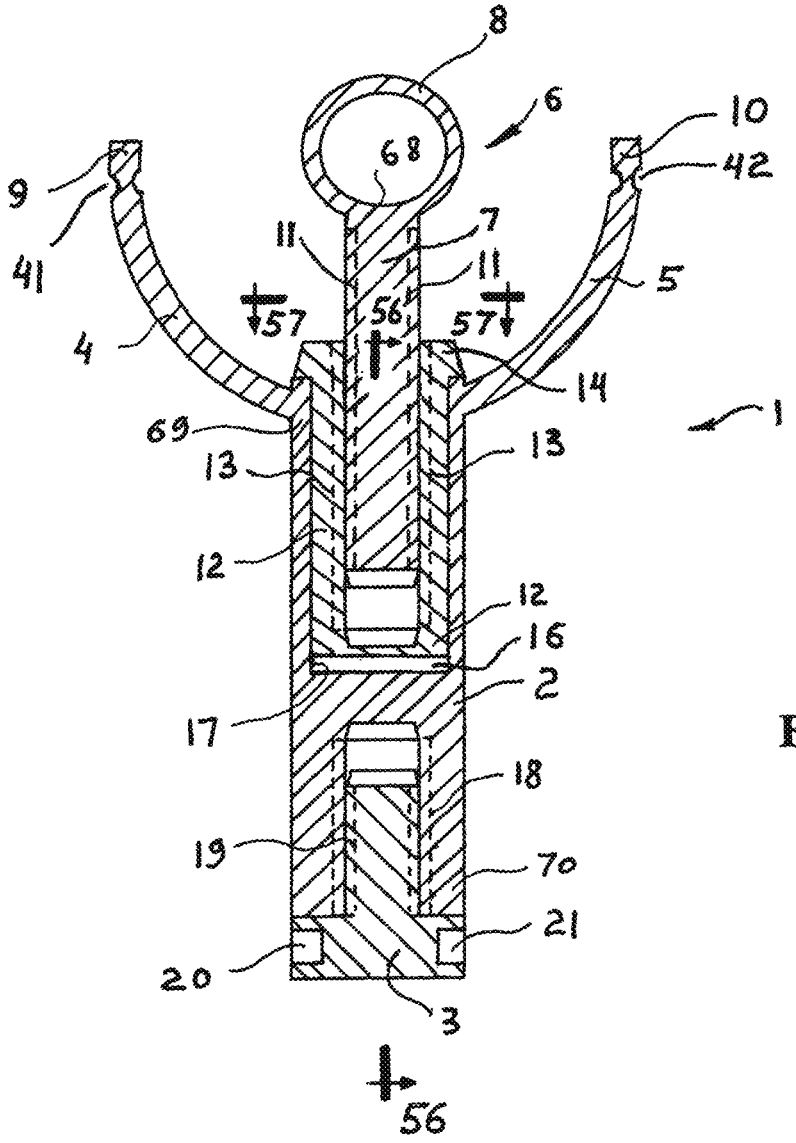

Referring to FIGS. 2-4, an improved slingshot 1 comprises a handle 2, a subhandle 3, a first sling member 4, a second sling member 5, a vertically adjustable directional member for arrow projectiles (a vertically adjustable arrow support) 6, including a body 7 and a ring 8, located in an upper portion 71 (FIGS. 14 and 16) of the body 7, an upper portion 9 of the first sling member 4 and an upper portion 10 of the second sling member 5. In the FIG. 2 a horizontal axis 30, which is perpendicular to the vertical axis 32 and perpendicular to an axis of shooting 34 in a direction of shooting 33 (FIGS. 5 and 6), is shown at its nominal (normal/regular) position when an angle $\beta=0°$, wherein the angle "β" is the angle between an adjusted axis 31 (FIG. 3) and horizontal axis 30 (FIG. 2). The nominal (normal/regular) position ($\beta=0°$) of the vertically adjustable directional member 6 for arrow projectile is mostly appropriate for the arrow shooting at the target (not shown) located preferably not so far from the shooter (sling operator) when the arrow gravitational effect may be not seriously considered, but if the target is located at the significant distance from the shooter, the directional member (the arrow support) 6 can be vertically adjusted, as it is shown in FIG. 3. Depending on the target distance from the shooter and coefficient (constant) of resilience of the first 35 and second 36 elastic members (FIGS. 5 and 24), the adjustment of angle "β" may generally be in the range from 1° to 5° ($\beta=1°\rightarrow5°$) or for some far away targets even slightly higher than 5°. In order to provide the angle $\beta>0°$ (FIG. 3), the vertically adjustable directional member 6 is slightly unscrewed from the handle insert 12 in the direction 72 (FIG. 3), i.e., slightly unscrewed from its nominal position when $\beta=0°$ (FIG. 2). For such purpose, the fine thread for the outer thread 11 of the body 7 and the inner thread 13 of the handle insert 12 can be used too.

It is known from many sources of the physics and mechanics that the maximal projectile velocity depends upon resilience of the material [e.g., strength of elastic members (bands/rubber) 35 and 36]. Such effect can be described by the following equation:

$$V=f_1(k) \quad (1)$$

wherein: V—a velocity;

$f_1$—a symbol of function (functional);

k—a coefficient (constant) of resilience of the used elastic material for first 35 and second 36 elastic members.

As it is also known, the kinetic energy depends upon mass and velocity. Such dependence can be mathematically described by the equation:

$$E_K=f_2(m,V) \quad (2)$$

wherein: $E_K$—kinetic energy;

$f_2$—symbol of function (functional);

m—a mass, and, as it is known, the kinetic energy $E_K$ is equal to the work $W_S$ for shifting (moving) subject (body) from its initial position at rest. This can be mathematically described as:

$$\left.\begin{matrix} E_K \\ W_S \end{matrix}\right\} = f_2(m, V) \quad (3)$$

wherein: $W_S$—a work for shifting subject (body) from its initial position at rest in compliance with the known integral/differential formula $$W_S = \int_{\psi_o}^{\psi_n} F d\psi_i$$

[wherein: $F=k\psi_i$—a force stretching the resilient material from its initial position $\psi_o$ to the fully stretched position $\psi_n$ for shooting;

$\psi_o$—an initial (not stretched) position of the resilient material for; elastic members 35 and 36;

$\psi_n$—the final (stretched position) of the resilient material for elastic members 35 and 36;

$\psi_i=\psi_n-\psi_o$—a distance the resilient material (e.g., elastic band or rubber 35 and 36) has been stretched, i=0, 1, 2, . . . , j, . . . , n].

The resulting function for the force stretching the resilient material (e.g., rubber of the elastic members 35 and 36) from its initial position to the final stretched position for shooting can be presented as:

$$F=f(m,V,k,\psi_i) \quad (4)$$

wherein: $f$—symbol of function (functional).

It is understandable, that not only outer thread 11 of the body 7 of the vertically adjustable directional member 6 can be used for the vertical adjustment of the position of the directional member 6. The other methods of the directional member 6 extension-retraction, for example, such as telescopic principles of the directional member 6 movements up (or down) can be used too. The position of each telescopic section/member (not shown) (if more than two telescopic sections/members/not shown/in the vertically adjustable directional member 6) can be fixed by any reasonable principles and fixative members (not shown), for instance, such as the decorative screw/not shown/, pin/not shown/, etc.

Referring to the most figures, and especially to FIGS. 2-4 and FIG. 11, an improved slingshot 1 is shown of Y-shape with the arms (first sling member 4 and second sling member 5) in U-shape, but it can be in any other reasonable regular or irregular geometrical shape/form.

The upper portions 9 and 10 of the first sling member 4 and second sling member 5 respectively, can be in any reasonable geometrical form/shape, for example, in the L-shape, as it is shown in the FIG. 1 (Prior Art), etc.

The upper portions 9 and 10 of the first sling member 4 and of the second sling member 5 respectively include a first groove 41 and a second groove 42 respectively (FIGS. 2-4). Exemplary, the first 41 and second 42 grooves are shown for the use of a first elastic member 35 and a second elastic member 36 are presented in the circular form of their cross-section (not shown) for coupling with a pouch 43 through a first hole 52 and a second hole 53 respectively (FIG. 23), but the elastic members 35 and 36 can be of the flat form (rectangular form) of their cross-section (not shown) for coupling with a pouch 43 through the first slot 50 and a second slot 51 respectively (FIGS. 21 and 22), or any other reasonable regular or irregular geometrical form/shape (e.g., square form/not shown/, etc.) It should be understandable, that more than two elastic members 35 and 36 can be used to provide more efficiency of the resilient material. Also, it is understandable that elastic members 35 and 36 can be produced, for example, from the synthetic or natural rubber, and the pouch 43 can be produced, for example, from the synthetic or natural leather.

Figure 11:
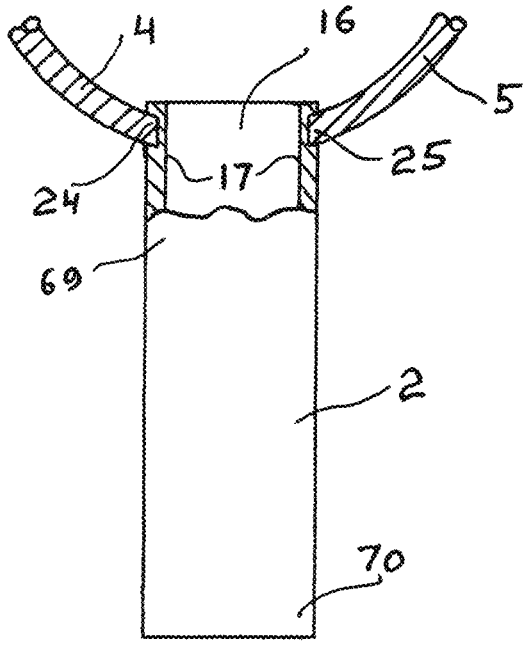
Figure 12:
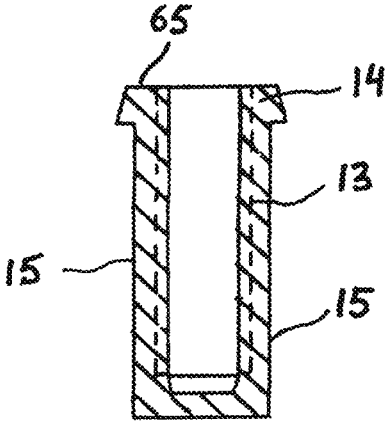
Figure 13:
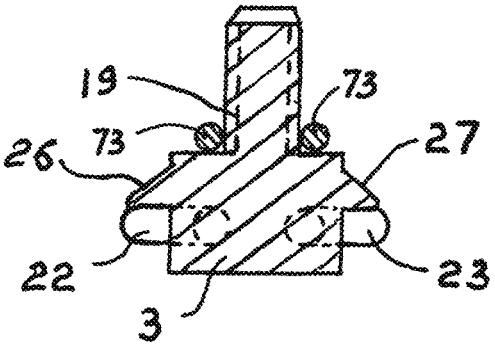

The first sling member 4 and the second sling member 5 are shown in the most figures, especially in FIG. 11, in the circular form of their cross-section (FIG. 11), but they can be of any reasonable regular or irregular geometrical form/shape. The sling members 4 and 5 can be of metallic material or any other reasonably suitable materials.

Figure 5:
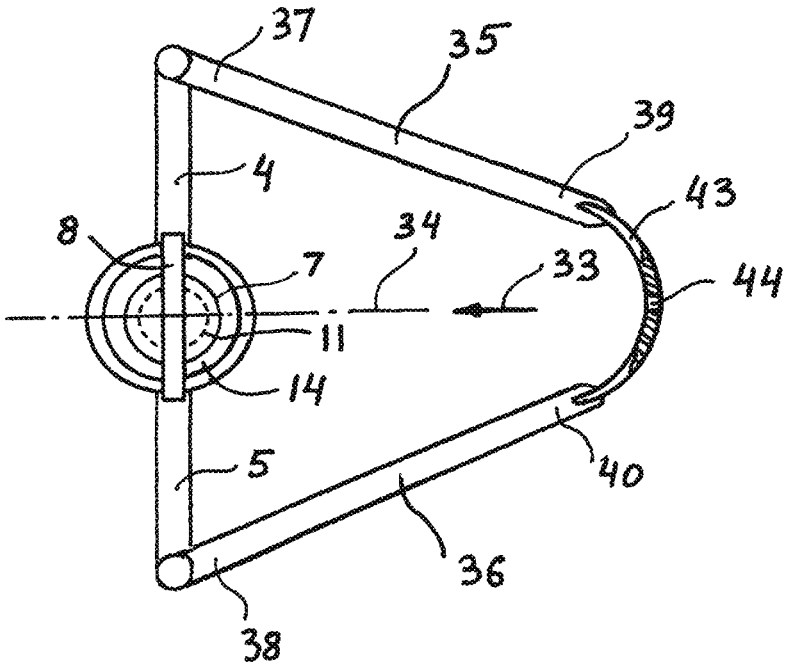
Figure 6:
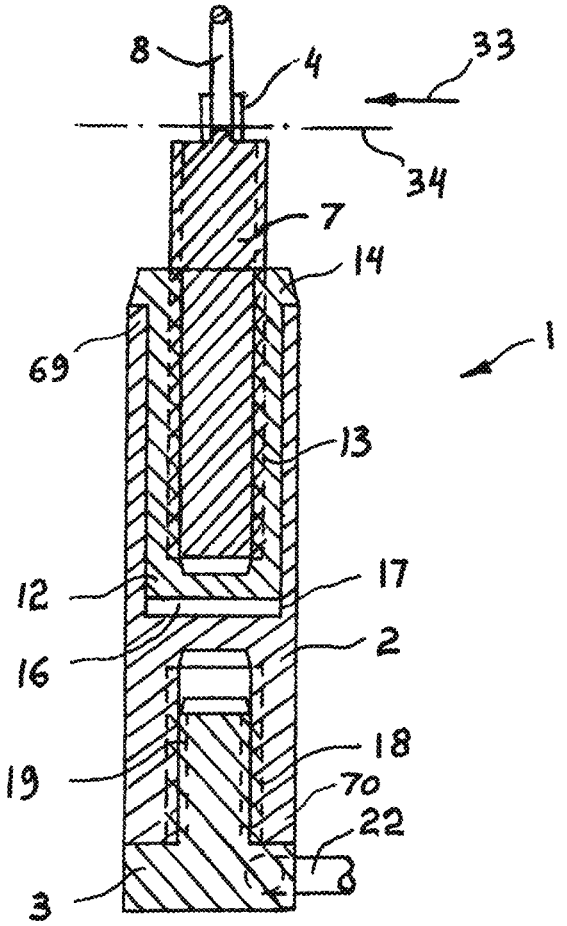
Figure 7:
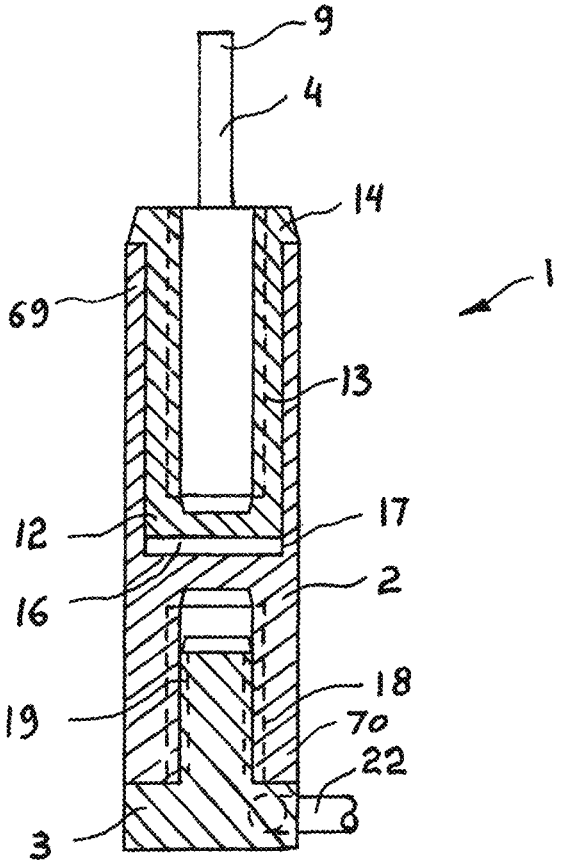

According to FIG. 5, the improved slingshot also includes a first end 37 and a second end 39 of the first elastic member 35 and a second end a first end 38 and a second end 40 of the second elastic member 36. An aperture 44 is located in the center of the pouch 43 (see also FIGS. 21-23).

Further, the body 7 (FIGS. 2-4, 6-10, 14, 15) of the vertically adjustable directional member 6 comprises an outer thread 11 for coupling with an inner thread 13 of the handle insert 12 having the truncated conic portion 14. The outer surface 15 (see FIGS. 9, 10, 12) of the handle insert 12 can have the ribbed surface (not shown) or rough surface (not shown) in order to be, for example, rigidly glued to the ribbed (not shown) or rough (not shown) inner surface 17 of the handle opening 16 located in an upper portion 69 (FIGS. 2-4, 6-11) of the handle 2. Any other reasonable types of rigid coupling (e.g., threading, welding, hot pressing, etc.) can be used too.

Figure 8:
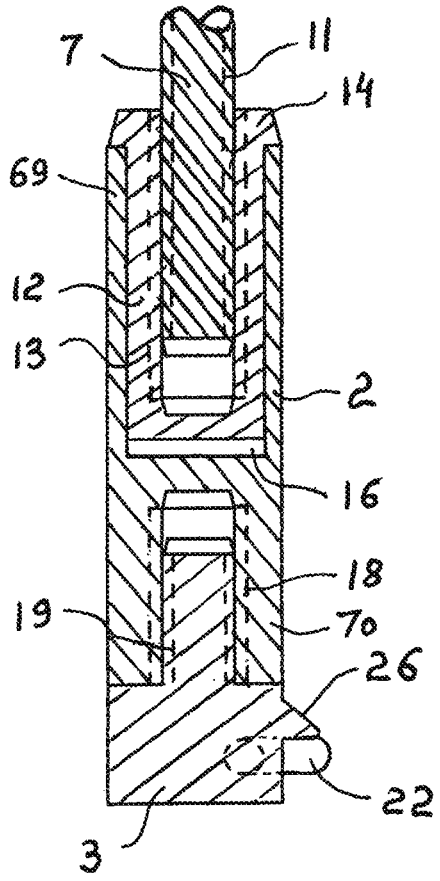

Also, the handle 2 of the improved slingshot 1 includes an inner thread 18, located in a lower portion 70 of the handle 2 (FIGS. 2-4, 6-11), for coupling with an outer thread 19 of the subhandle 3, which comprises a first opening 20 and a second opening 21 (FIG. 4) for insertion of a first arm 22 (FIG. 3) of an arm rest (not shown) and a second arm 23 (FIG. 3) of the arm rest (not shown) respectively in the first opening 20 and second opening 21 (FIG. 4) of the subhandle 3. The subhandle 3 can have a first projection 26 (as an arm rest first arm stopper)/FIGS. 8 and 13/and a second projection 27 (as an arm rest second arm stopper)/FIG. 13/extending from the subhandle 3, thereby limiting further counterclockwise movements of the first 22 and second 23 arms of the arm rest (not shown) after the arm rest (not shown) is resting on the forearm of the shooter (on the forearm of the slingshot's operator). The arm rest (not shown) can be clockwise foldable for compactness. The first 26 and second 27 projections can be rigidly attached (not shown) to the subhandle 3, for example, by glue, screw(s), welding, hot pressing and by any other reasonably suitable principles and methods of coupling. As an example, the subhandle 3 is shown in FIG. 8 with the first projection 26 and first arm 22, but in FIG. 13 the subhandle 3 is shown with the first 26 and second 27 projections, and with the first 22 and second 23 arms of the arm rest [the arms 22 and 23 are also shown in FIGS. 2 and 3]. The projections 26 and 27 of the subhandle 3 can be produced by the molding process during manufacturing of the subhandle 3.

The handle 2 can be also manufactured by the molding process.

Figure 9:
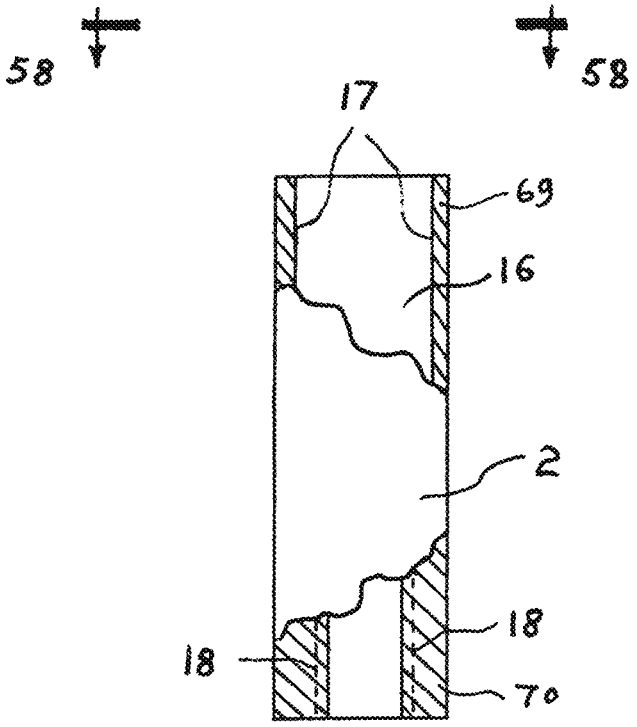
Figure 10:
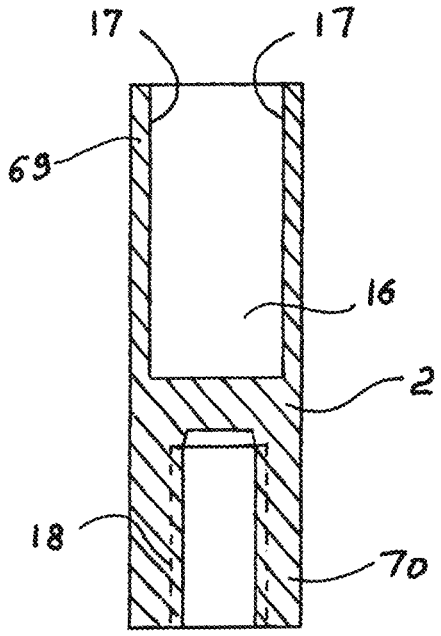

FIG. 9 and FIG. 10 depict the handle 2 of the improved slingshot 1 comprising the handle opening 16 for handle insert 12 installation, and the inner thread 18 for coupling with the subhandle 3.

In FIG. 4 the first sling member 4, second sling member 5 and the handle 2 are shown as a solid (entire) part of the improved slingshot 1, but referring to FIG. 11, the first sling member 4 and second sling member 5 can for example be inserted into handle 2. The lower portion 24 of the first sling member 4, and the lower portion 25 of the second sling member 5 can have, for example, the square form or plane form to be rigidly coupled with the handle corresponding openings (not shown) having the analogous square or plane forms respectively. Other types of rigid coupling, for instance such as gluing, threading, welding, hot pressing, etc., can be used too.

Figure 14:
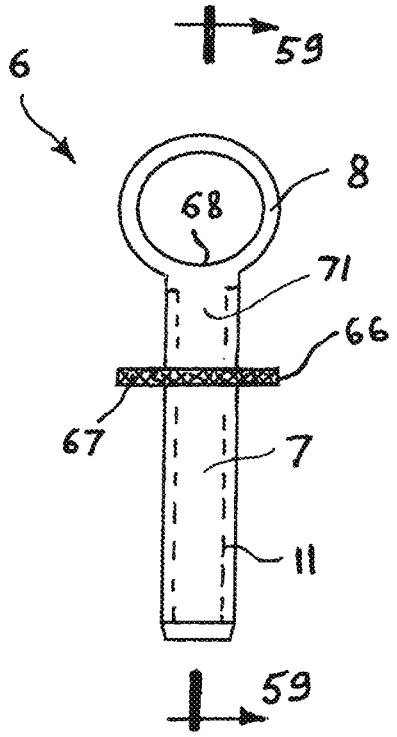
Figure 15:
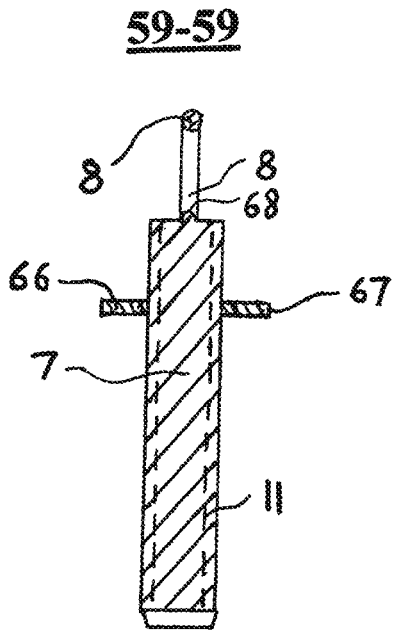

Referring to FIGS. 14 and 15, the vertically adjustable directional member 6 is shown with a nut 66 having a texture 67. The nut 66 is intended for fixing position of the vertically adjustable directional member 6 before the shooting by tightening the nut 66 to an upper surface 65 (FIG. 12) of the truncated conic portion 14. The texture 67 is provided for slingshot's operator (shooter) convenience to fix the position of the vertically adjustable directional member 6.

Figure 16:
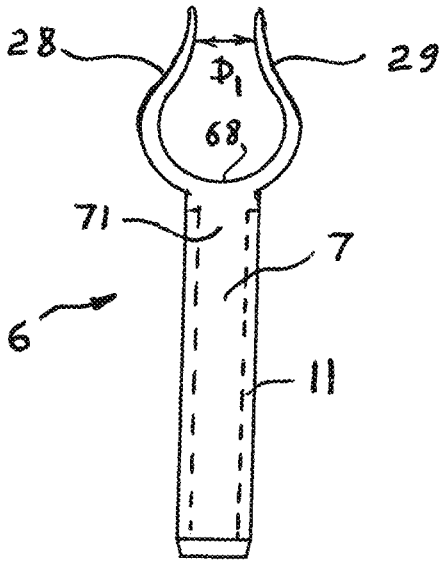
Figure 17:
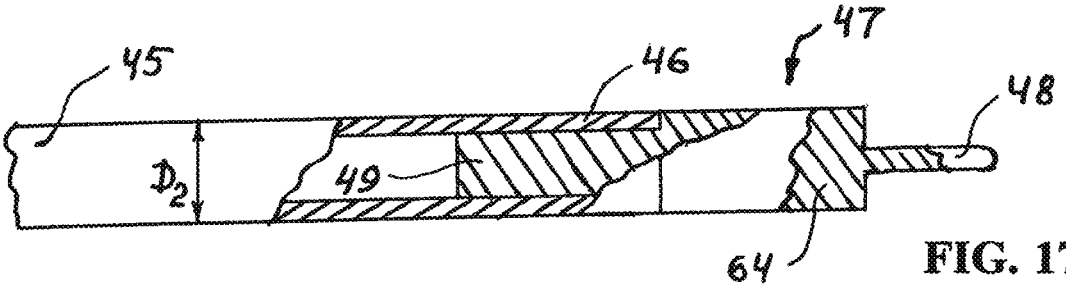
Figure 18:
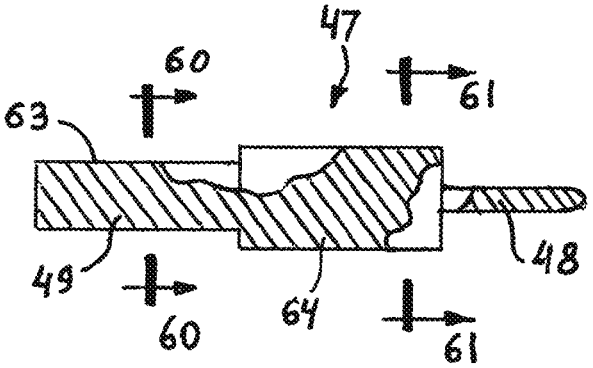

FIG. 16 illustrates another variant of the vertically adjustable directional member 6 for arrow projectiles. According to FIG. 16, the vertically adjustable directional member 6 comprises a first sprang member 28 of the vertically adjustable directional member 6 and a second sprang member 29 of the vertically adjustable directional member 6. The distance "$D_1$" between the first 28 and second 29 sprang members of the vertically adjustable directional member 6 is slightly less than diameter "$D_2$" of the arrow projectile 45 (FIG. 17), i.e.: $D_1<D_2$. Such correlation of the distance "$D_1$" between the first 28 and second 29 sprang members of the vertically adjustable directional member 6 and diameter "$D_2$" of the arrow projectiles can provide an easy installation of the arrow projectile 45 through the ring 8 (or ring-alike semicircular-style article shown in FIG. 16) of the vertically adjustable directional member 6 for shooting. The material for the ring 8 (FIGS. 2-6, 14, 15) of the vertically adjustable directional member 6, as well as, for the first 28 and second 29 sprang members of the vertically adjustable directional member 6 can be selected from materials having not high coefficient (constant) of friction, for example, such as Nylon, PTFE (polytetrafluorethylene), PVC, etc., especially for the lower (saddle) portion 68 of the ring 8 (FIG. 4, 14, 15, also see FIG. 16), on which the arrow projectile 45 is leaned. Any other reasonably suitable material can be used too.

FIGS. 17-20 illustrate a nock 47 and its coupling with the arrow projectile 45. The nock 47 comprises a nock projection 48, a nock member 49 and a nock middle member 64. The nock member 49 is installable in a rear portion 46 of the arrow projectile 45. The nock 47 can be of solid (entire) configuration, as shown in FIGS. 17-20 (e.g., molded, etc.); or the nock projection 48, a nock member 49 and a nock middle member 64 can be connected to each other, for example by threads, glue, etc. and other reasonably suitable principles and methods of coupling (e.g., welded, etc.)

FIGS. 21-23 are related to a pouch 43. FIGS. 21 and 22 illustrate the pouch comprising a first slot 50 and a second slot 51, and FIG. 23 illustrates the pouch comprising a first hole 52 and a second hole 53 intended for coupling with the different types of the form of the cross-section of the first 35 and second 36 elastic members, as it has been described hereinabove. Again, it is also understandable, that the coupling of the first 35 and second 36 elastic members to the first 41 and second grooves of the first 4 and second 5 sling members respectively can be provided by any reasonable principles different than described in this invention. For example, the elastic members 35 and 36 can be coupled to the L-shaped sling members 4 and 5 respectively in the manner described in the prior art (for instance, as shown in FIG. 1). In the same manner, the coupling of the elastic members 35 and 36 to the pouch 43 can be provided by any other reasonable principles (e.g., see FIG. 1).

Figure 24:
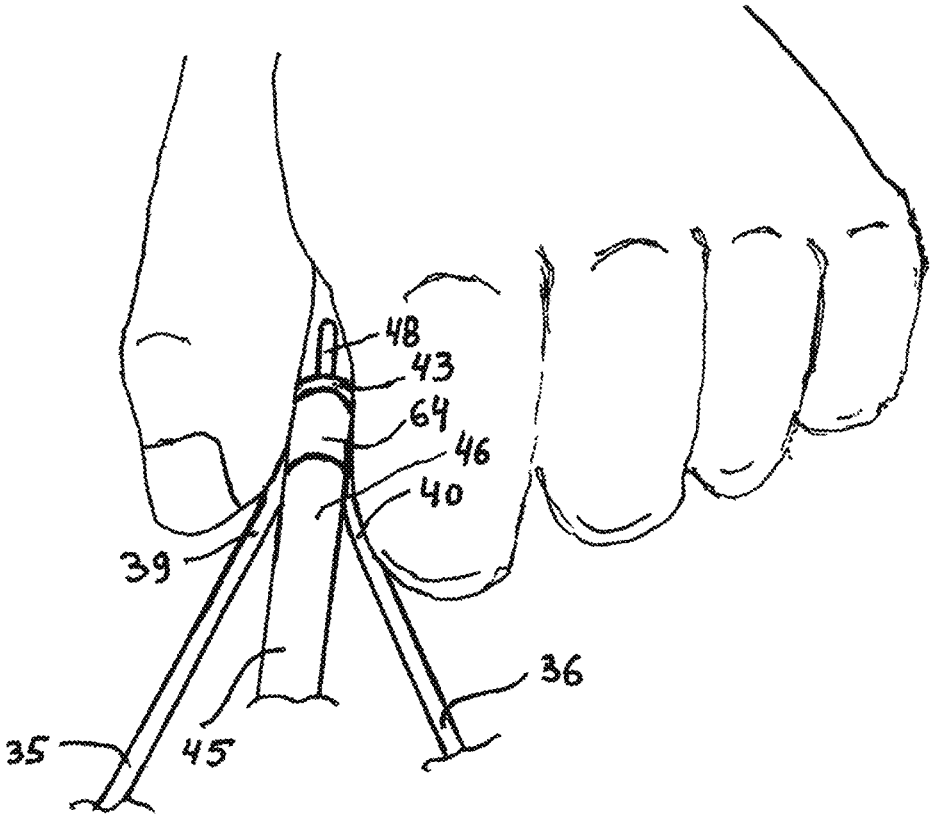
FIG. 24 is a simplified exemplary view of gripping (grabbing) the arrow nock in the pouch by the slingshot operator (shooter).

The FIG. 24 illustrates the shooter's firm gripping of the nock middle member 64, surrounded by the pouch 43, by the thumb and index finger, wherein the nock projection 48 is inserted through the aperture 44 (not shown in FIG. 24) of the pouch 43 and the pouch's nock member 49 is inserted into the rear portion 46 of the arrow projectile 45. The nock middle member 64 can be also provided, for example, by the index finger and middle finger.

When the vertically adjustable directional member 6 for the use of arrow-type projectiles is not installed (not screwed-in the handle insert 12), the slingshot 1 can be used for shooting of the traditional slingshot's projectiles, such as balls (not shown), spheres (not shown), rounded stones (not shown) and other alike slingshot's traditional projectiles (not shown).

The gasket 73, for instance such as rubber gasket, etc., can be installed between handle 2 and subhandle 3 (FIG. 13) to eliminate free (unlimited and independent) pivotability of the subhandle 3 with respect to the grabbed position of the handle 2, thereby, making the pivotability of the arm rest (not shown) on the forearm less loosen, because the subhandle 3 with the installed first 22 and second 23 arms of the arm rest (not shown) respectively in the first 20 and second 21 openings of subhandle 3 would be less rotatable due to the gasket 73. For such purpose, the fine thread (not shown) in addition to the gasket 73 can be used too. The handle 2 can be also manufactured in compliance with the molding procedures, and can meet all wrist ergonomic features [e.g., grooves for fingers (not shown), etc.] for slingshot operator's convenience.

The small feathers (not shown) or the thin silk threads (not shown) can be used at the rear portion 46 of the arrow projectile 45.

With respect to the description of this invention, it is to be realized that the optimum dimensional relationships for the parts of the invention, to include variations in size, materials, configurations, shape, form, function and manner of operation, assembly and use, are deemed readily apparent and obvious to one skilled in the art, and all equivalent relationships to those illustrated in the drawings and described in the specification are intended to be encompassed by the present invention.

Many modifications and variations are possible in view of the above teachings, and any and all modifications and variations may be effected without departing from the spirit and scope of the novel concept of the present invention. It is therefore to be understood that, within the spirit and scope of the novel concepts of the present invention and the appended claims hereinbelow, the invention may be practiced otherwise than specifically described. It is also should be understandable, that the invention is susceptible to changes or alterations without defeating its teaching and practicability.

It is therefore to be understood that, within the scope of the appended claims, the invention may be practiced otherwise than specifically described. The present disclosure is to be considered an exemplification of the principles of the invention and is not intended to limit the spirit or/and scope of the invention and/or claims of the embodiments illustrated. From the foregoing and as mentioned above, it will be observed that numerous variations and modifications may be effected without departing from the spirit and scope of the novel concept of the invention. The described embodiments comprise different features, not all of which are required in all embodiments of the invention. The above description utilizes only some of the features or possible combinations of the features, and does not limit the scope of the present invention.

No limitation with respect to the specific principles and apparatus, illustrated hereinabove, is intended or should be inferred. Various omissions, substitutions and changes in the forms and details of the device illustrated and in its operation can be made by those skilled in the art without departing from the spirit of the invention.

The additional modifications and improvements of the present invention may also be apparent to those of ordinary skill in the art. Thus, the particular combination of steps of operations and/or parts/components/members/portions described and illustrated herein is intended to represent only certain embodiments of the present invention, and is not intended to serve as limitations of alternative devices within the spirit and scope of the invention.

All expressions and terms, which have been employed herein are used as terms of description and not of limitation, and there is no intention, in the use of such terms and expressions, of excluding any equivalents of the features shown and described or portions thereof but it is recognized that various modifications are possible within the scope of the invention claimed, and the additional features of the present disclosure will become apparent to those skilled in the art upon consideration of illustrative embodiments exemplifying the best mode of carrying out the disclosure as presently perceived.

What is claimed is:

1. A slingshot with vertically adjustable directional member and nock for arrow projectile comprising a handle including a handle opening located in an upper portion of said handle;

a handle inner thread located in a lower portion of said handle;

a subhandle including a first opening for coupling with a first arm and a second opening for coupling with a second arm;

a subhandle outer thread for coupling with said handle inner thread of said lower portion of said handle;

a handle insert for installation in said handle opening of said handle including a truncated conic portion;

a handle insert inner thread;

a first elastic member and a second elastic member, wherein said first elastic member comprises a first end of said first elastic member and a second end of said first elastic member, and said second elastic member comprises a first end of said second elastic member and a second end of said second elastic member;

a pouch, comprising an aperture in a center of said pouch, and which is coupled to a second end of said first elastic member and to a second end of said second elastic member, wherein a first end of said first elastic member is coupled to an upper portion of a first sling member and a first end of said second elastic member is coupled to an upper portion of a second sling member, and wherein said first sling member and said second sling member are rigidly connected to said upper portion of said handle;

a vertically adjustable directional member for an arrow projectile including a body comprising a body outer thread for coupling with said handle insert inner thread, wherein said body outer thread provides an adjustment of an angle of an extension-retraction of said vertically adjustable directional member for a consideration of a gravitational effect of said arrow projectile during their flying process to a target;

a ring located in an upper portion of said body of said vertically adjustable directional member, wherein said ring is rigidly connected to said upper portion of said body;

a nock comprising a nock middle member, nock projection insertable through said aperture, a nock member insertable in a rear portion of said arrow projectile.

2. The slingshot of claim 1, wherein further said first sling member and said second sling member are extended from said upper portion of said handle.

3. The slingshot of claim 1, wherein further said ring is extended from said upper portion of said body of said vertically adjustable directional member.

4. The slingshot of claim 1, wherein further said body outer thread and said handle insert inner thread are a fine thread.

5. The slingshot of claim 1, wherein further a gasket is installed between said handle and said subhandle.

6. The slingshot of claim 1, wherein further said vertically adjustable directional member comprises a telescopic structure.

7. The slingshot of claim 6, wherein further said vertically adjustable directional member of said telescopic structure comprises a fixative member for a secured position of telescopic sections.

8. The slingshot of claim 7, wherein further said fixative member is a screw with a decorative configuration of a head of said screw.

9. The slingshot of claim 8, wherein further said fixative member is a pin with a decorative configuration of a head of said pin.

* * * * *